US009183790B2

(12) United States Patent
Lee et al.

(10) Patent No.: US 9,183,790 B2
(45) Date of Patent: Nov. 10, 2015

(54) LIQUID CRYSTAL DISPLAY WITH CONTROLLABLE BACKLIGHT FOR INCREASED DISPLAY QUALITY AND DECREASED POWER CONSUMPTION

(75) Inventors: Yong Kon Lee, Seoul (KR); Tae Wook Lee, Ulsan (KR)

(73) Assignee: LG DISPLAY CO., LTD., Seoul (KR)

( * ) Notice: Subject to any disclaimer, the term of this patent is extended or adjusted under 35 U.S.C. 154(b) by 1856 days.

(21) Appl. No.: 11/168,383

(22) Filed: Jun. 29, 2005

(65) Prior Publication Data

US 2006/0208999 A1 Sep. 21, 2006

(30) Foreign Application Priority Data

Dec. 29, 2004 (KR) ..... 10-2004-0115731

(51) Int. Cl.
*G09G 3/34* (2006.01)

(52) U.S. Cl.
CPC ..... *G09G 3/3426* (2013.01); *G09G 2320/0271* (2013.01); *G09G 2320/064* (2013.01); *G09G 2330/021* (2013.01); *G09G 2360/16* (2013.01)

(58) Field of Classification Search
USPC ..... 345/87–104
See application file for complete search history.

(56) References Cited

U.S. PATENT DOCUMENTS

| | | | | |
|---|---|---|---|---|
| 2001/0033260 | A1* | 10/2001 | Nishitani et al. | 345/87 |
| 2003/0090455 | A1* | 5/2003 | Daly | 345/102 |
| 2003/0190063 | A1* | 10/2003 | Acharya et al. | 382/128 |
| 2003/0222841 | A1* | 12/2003 | Hirosue | 345/89 |
| 2004/0001040 | A1* | 1/2004 | Kardach et al. | 345/102 |
| 2004/0257329 | A1* | 12/2004 | Park et al. | 345/102 |
| 2006/0013015 | A1* | 1/2006 | Hashimoto | 362/600 |
| 2008/0186707 | A1* | 8/2008 | Ku et al. | 362/253 |

* cited by examiner

*Primary Examiner* — William Boddie
*Assistant Examiner* — Bipin Gyawali
(74) *Attorney, Agent, or Firm* — Birch, Stewart, Kolasch & Birch, LLP

(57) ABSTRACT

A liquid crystal display device and a controlling method thereof are provided. The liquid crystal display device includes a liquid crystal display panel screen divided into a plurality of areas; a plurality of backlight sources to selectively irradiate light respectively to the divided areas of the screen; and a controller to obtain at least one intermediate brightness value associated with data for at least one of the divided areas and to control a brightness of at least one of the backlight sources corresponding to the at least one divided area according to the at least one intermediate brightness value.

10 Claims, 6 Drawing Sheets

LIQUID CRYSTAL DISPLAY WITH CONTROLLABLE BACKLIGHT FOR INCREASED DISPLAY QUALITY AND DECREASED POWER CONSUMPTION

This application claims the benefit of the Korean Patent Application No. 10-2004-0115731 filed on Dec. 29, 2004 in Republic of Korea, which is hereby incorporated by reference.

BACKGROUND OF THE INVENTION

1. Field of the Invention

The present invention relates to a liquid crystal display device, and more particularly to a liquid crystal display device that is adapted for enabling an active control of backlight brightness for each of areas included in a screen. The present invention also relates to a method of controlling the liquid crystal display device.

2. Description of the Related Art

A liquid crystal display device is mostly fabricated in a transmission type where a backlight unit 12 is installed at the rear surface of a liquid crystal display panel 11 as shown in FIG. 1. The liquid crystal display panel 11 of the transmission type liquid crystal display device, as shown in FIG. 1, controls the transmissivity of the light incident from the backlight unit 12 in accordance with video data to display an image.

The backlight unit 12 includes a lamp, a light guide panel to convert a linear light from the lamp into a planar light, and an optical sheet such as a diffusion sheet and a prism sheet to increase the uniformity and efficiency of the light. The lamp of the backlight unit 12 generates a discharge within a discharge tube between an anode and a cathode in accordance with a tube current from an inverter 14 to generate a white light.

The inverter 14 converts a DC power from a power source 13 into an AC power and boosts the AC power to generate the tube current.

Generally, the brightness of the backlight unit 12 is fixed. Because of this, the liquid crystal display device has lower brightness than the related art cathode ray tube CRT, its maximum brightness is fixed, and its contrast ratio is low. Thus, there is a problem in that the display quality of the related art liquid crystal display device is low.

SUMMARY OF THE INVENTION

Accordingly, it is an object of the present invention to provide a liquid crystal display device for increasing a display quality by actively controlling the brightness of the liquid crystal display device in accordance with video data and decreasing the heating value of a backlight unit and its power consumption, and to provide a controlling method thereof.

It is another object of the present invention to provide a liquid crystal display device where a screen is divided into a plurality of areas and that is adaptive for selectively controlling the brightness of a backlight in each of the divided areas in accordance with video data, and to provide a controlling method thereof.

In order to achieve these and other objects of the invention, a liquid crystal display device according to an aspect of the present invention includes a liquid crystal display panel screen divided into a plurality of areas; a plurality of backlight sources to selectively irradiate light respectively to the divided areas of the screen; and a controller to obtain at least one intermediate brightness value associated with data for at least one of the divided areas and to control a brightness of at least one of the backlight sources corresponding to the at least one divided area according to the at least one intermediate brightness value.

According to another aspect of the present invention, there is provided a liquid crystal display device, comprising: a liquid crystal display panel screen divided into a plurality of areas; and a controller to obtain an intermediate brightness value associated with data for each of the divided areas and to modulate the data according to the obtained intermediate brightness values for displaying.

According to another aspect of the present invention, there is provided a method of controlling a liquid crystal display device, the liquid crystal display device including a liquid crystal display panel screen divided into a plurality of areas, and a plurality of backlight sources, the method comprising: obtaining at least one intermediate brightness value associated with input data for at least one of the divided areas; and controlling a brightness of at least one of the backlight sources corresponding to the at least one divided area according to the at least one intermediate brightness value.

According to another aspect of the present invention, there is provided a method of controlling a liquid crystal display device, the liquid crystal display device including a liquid crystal display panel screen divided into a plurality of areas, the method comprising: obtaining an intermediate brightness value associated with data for each of the divided areas; and modulating the data according to the obtained intermediate brightness values for displaying.

These and other objects of the present application will become more readily apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENTS

Reference will now be made in detail to the preferred embodiments of the present invention, examples of which are illustrated in the accompanying drawings.

Hereinafter, the preferred embodiments of the present invention will be described in detail with reference to FIGS. 2 to 6.

Figure 1:
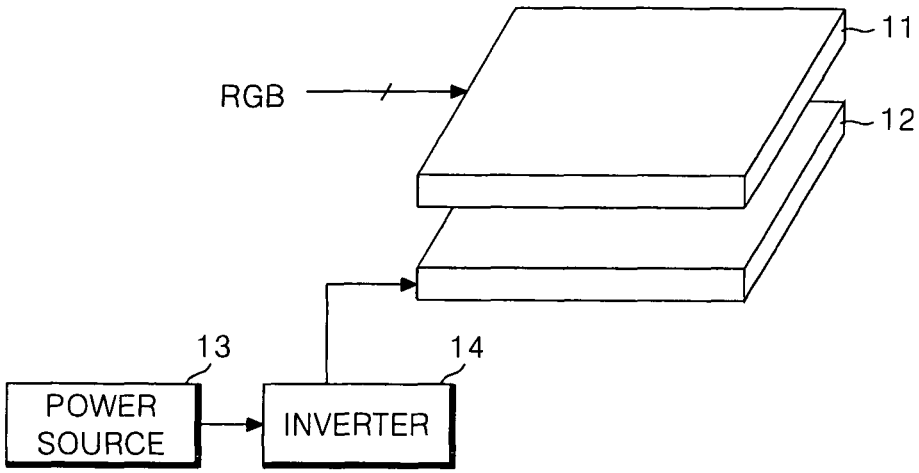
FIG. 1 RELATED ART
FIG. 1 is a diagram briefly representing a related art liquid crystal display device.
Figure 2:
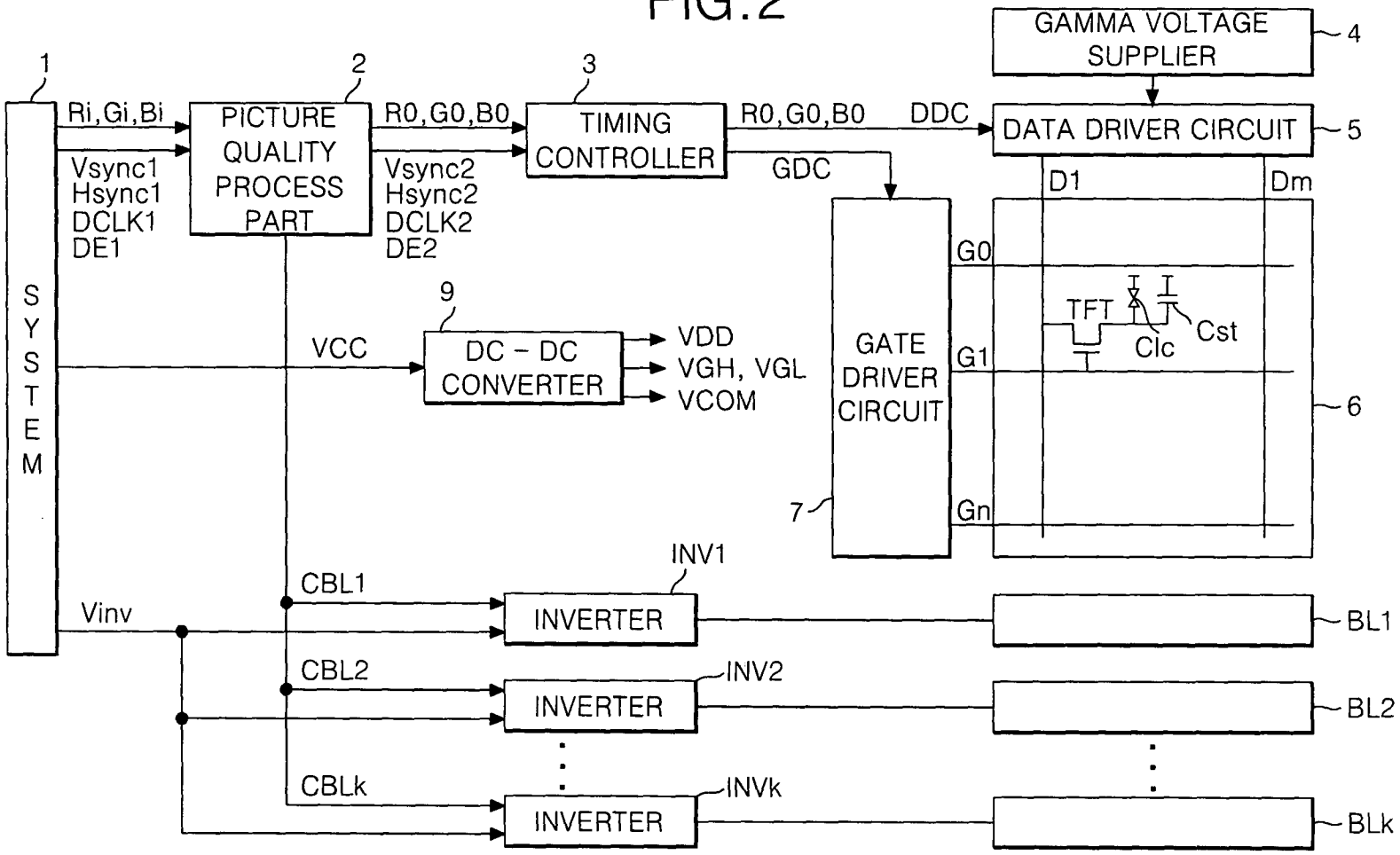
FIG. 2 is a block diagram representing a liquid crystal display device according to an embodiment of the present invention.

Referring to FIG. 2, a liquid crystal display device of the present invention according to an embodiment includes a liquid crystal display panel 6 which has an m×n number of liquid crystal cells Clc arranged in a matrix configuration, the m number of data lines D1 to Dm crossing the n number of gate lines G1 and Gn, and a TFT formed at an intersection thereof; a gamma voltage supplier 4 to generate an analog gamma compensation voltage; a data driver circuit 5 to supply data to the data lines D1 to Dm of the liquid crystal display panel 6; a gate drive circuit 7 to supply a scan signal to the gate lines G1 to Gn; a k number (k is an integer of not less than 2) of backlight sources BL1 to BLk to irradiate light to each of a plurality of areas which are pre-set in the liquid crystal display panel 6; a k number of inverters INV1 to INVk to drive correspondingly the backlight sources BL1 to BLk; a picture quality process part 2 to modulate the brightness of the data input thereto and to control the brightness of each backlight source BL1 to BLk in accordance with the data; a timing controller 3 to control the data driver circuit 5 and the gate driver circuit 7; and a direct current to direct current converter 9 (hereinafter, referred to as "DC-DC converter") to generate a drive voltage of the liquid crystal display panel 6. All the components of the liquid crystal display device are operatively coupled.

In FIG. 2, "Ri", "Gi" and "Bi" are a tri primary color digital video data supplied to the picture quality process part 2 from a system 1. "Ro", "Go" and "Bo" are the data modulated by the picture quality process part 2, and are the tri primary color digital video data supplied to the timing controller 3. "Vsyn1", "Hsync1", "DCLK1" and "DE1" are timing control signals supplied from the system 1 to the picture quality process part 2 and represent a vertical/horizontal synchronization signal Vsyn1, Hsyn1, a dot clock DCLK1 for sampling a digital video data and a data enable signal DE1 to indicate a period when the digital video data Ri, Gi, Bi exist. "Vsyn2", "Hsync2", "DCLK2" and "DE2" are timing signals modulated by the picture quality process part 2.

The liquid crystal display panel 6 has a liquid crystal injected into two glass substrates. Data lines D1 to Dm and gate lines G1 to Gn formed on a lower glass substrate of the liquid crystal display panel 6 cross each other. A thin film transistor (hereinafter, referred to as "TFT") formed at each of intersections of the data lines D1 to Dm and the gate lines G1 to Gn supplies a data voltage from the corresponding data line to a liquid crystal cell Clc in response to a scan signal from the corresponding gate line. For this, a gate electrode of the TFT is connected to the corresponding gate line, and a source electrode is connected to the corresponding data line. And a drain electrode of the TFT is connected to the pixel electrode of the liquid crystal cell Clc.

There are also formed a black matrix, a color filter and a common electrode (not shown) on an upper glass substrate of the liquid crystal display panel 6. And polarizers of which the light axes cross each other are stuck to a light exit surface of the upper glass substrate and a light incidence surface of the lower glass substrate of the liquid crystal display panel 15. An alignment film for setting a pre-tilt angle of the liquid crystal is formed in each of a liquid crystal opposite surface of the lower glass substrate and a liquid crystal opposite surface of the upper glass substrate. Further, a storage capacitor Cst is formed in each liquid crystal cell Clc of the liquid crystal display panel 6. The storage capacitor Cst is formed between a pixel electrode of the liquid crystal cell Clc and the previous stage gate line, or between the pixel electrode of the liquid crystal cell Clc and a common electrode line (not shown) to act to fixedly sustain the voltage of the liquid crystal cell Clc.

The liquid crystal display panel in the present invention is not limited to the liquid crystal display panel 6 shown in FIG. 2, but can be any known liquid crystal display panel.

A graphic process circuit of the system 1 converts analog data into digital video data Ri, Gi, Bi and controls the color temperature and resolution of the digital video data Ri, Gi, Bi. And the graphic process circuit of the system 1 generates a first vertical, horizontal synchronization signal Vsync1, Hsync1, a first clock signal DCLK1 and a first data enable signal DE1. A power source part of the system 1 supplies a power voltage VCC to the DC-DC converter 9 and supplies an inverter DC input voltage Vinv to the inverters INV1 to INVk.

The picture quality process part 2 modulates the brightness of the digital video data Ri, Gi, Bi to make a dark part darker and a bright part brighter in order to expand a dynamic range of data, extracts a intermediate brightness value of the digital video data Ri, Gi, Bi in each of a plurality of areas into which the screen of the liquid crystal display panel 6 is pre-divided, and generates a k number of backlight control signals CBL1 to CBLk corresponding respectively to the obtained intermediate values to selectively control the brightness of the backlight sources BL1 to BLk respectively. Further, the picture quality process part 2 modulates the timing signals Vsync1, Hsync1, DCLK1, DE1 from the system 1 to generate the timing signals Vsync2, Hsync2, DCLK2, DE2 synchronized with the modulated digital video data Ro, Go, Bo.

The gamma voltage supplier 4 divides a high potential power voltage VDD from the DC-DC converter 9 and a low potential power voltage VSS, which is set as a ground voltage, to generate analog gamma compensation voltages of which each corresponds to each gray level of the digital video data Ro, Go, Bo.

The data driver circuit 5 converts the digital video data Ro, Go, Bo into the analog gamma compensation voltage from the gamma voltage supplier 4 in response to a control signal DDC from the timing controller 3, and supplies the analog gamma compensation voltage as a data voltage to the data lines D1 to Dm of the liquid crystal display panel 6.

The gate driver circuit 7 generates a scan pulse of gate voltage VGH, VGL and sequentially supplies the scan pulse to the gate lines G1 to Gn in response to a control signal GDC from the timing controller 3, and selects a horizontal line of the liquid crystal display panel 6 to which the data signal is to be supplied.

The timing controller 3 supplies the digital video data Ro, Go, Bo inputted from the picture quality process part 2 to the data driver circuit 5, and generates the control signals GDC, DDC for controlling respectively the gate driver circuit 7 and the data driver circuit 5 by use of the timing control signals Vsync2, Hsync2, DCLK2, DE2. The control signal GDC of the gate driver circuit 7 includes a gate start pulse GSP, a gate shift clock GSC, a gate output signal GOE and so on. The control signal DDC of the data driver circuit 5 includes a source start pulse SSP, a source shift clock SSC, a source output signal SOC, a polarity signal POL and so on.

The DC-DC converter 9 generates a high potential power voltage VDD, a common voltage VCOM, a gate high voltage VGH, and a gate low voltage VGL by use of the power voltage VCC which is inputted from the power source part of the system 1. The common voltage VCOM is a voltage supplied to the common electrode of the liquid crystal cell Clc. The gate high voltage VGH is a high logic voltage of the scan pulse, which is set to be above the threshold voltage of the TFT, and the gate low voltage VGL is a low logic voltage of the scan pulse, which is set to be an off voltage of the TFT.

The inverters INV1 to INVk convert the DC input voltage Vinv to an AC voltage by use of a pulse width modulation PWM method or a pulse frequency modulation PFM method, and boost the AC voltage to generate an AC tube current. The backlight sources BL1 to BLk are turned on and off in accordance with the AC tube current. The inverter INV1 to INVk make the duty ratio of the tube current and the strength of the lamp tube current different in response to the control signals CBL1 to CBLk from the picture quality process part 2. Herein, the duty ratio of the lamp tube current means the ratio of lamp on/off periods of the backlight sources BL1 to BLk within one frame period.

Figure 3:
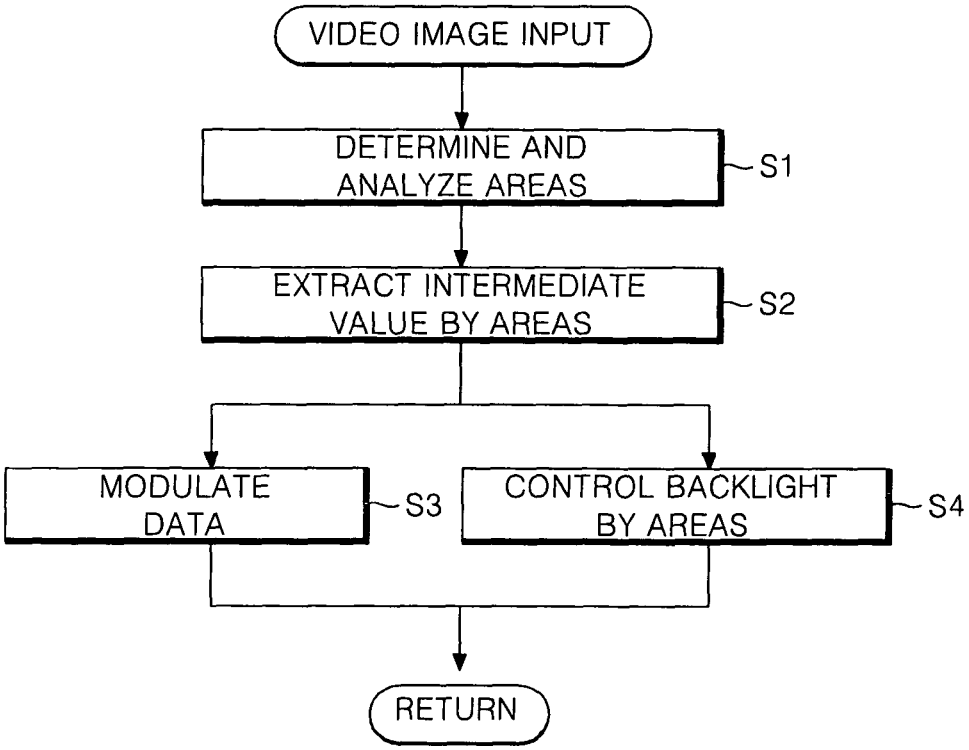
FIG. 3 is a flow chart representing a control process of a picture quality process part 2 shown in FIG. 2 step by step.

FIG. 3 is a flow chart representing a control sequence of the picture quality process part 2 step by step.

Figure 4:
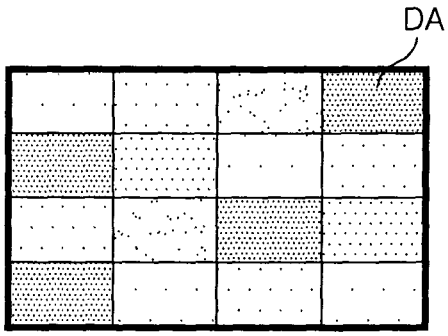
FIG. 4 is a diagram representing an example of a screen divided into a plurality of areas according to the present invention.

Referring to FIG. 3, the picture quality process part 2 divides the screen of the liquid crystal display panel 6 into an x-number (x is an integer of not less than 2) of areas. (S1) As an example, x may be equal to k such that each backlight source corresponds to one of the divided screen areas. FIG. 4 is a diagram representing an example of a liquid crystal display panel screen divided into a plurality of areas. In this example, the panel is divided into 16 areas to produce 16 divided areas (DAs) where the backlight brightness for each DA can be independently controlled.

Figure 5:
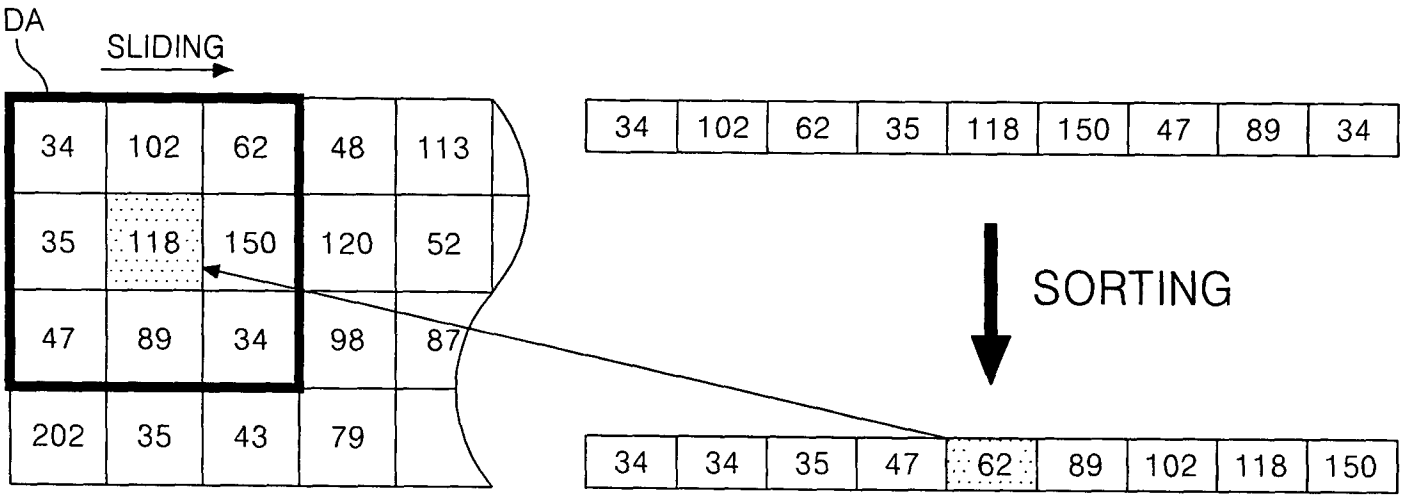
FIG. 5 is a diagram representing an example of extracting an intermediate value according to the present invention.

The picture quality process part 2 extracts the intermediate brightness value for the digital video data Ri, Gi, Bi in each of the divided areas of the panel, subsequently to the step S1. (S2) A median filter can be used in the picture quality processing part 2 to perform the process of obtaining these intermediate values. FIG. 5 represents an example of an intermediate value extracting process for one of the divided areas using the median filter. Referring to FIG. 5, assume that the size of each divided area DA on the liquid crystal display panel screen is 3×3 pixels and the brightness value of the data to be displayed within one such area is "34, 102, 62, 35, 118, 150, 47, 89, 34", for example. In that case, the median filter sorts these brightness values in order, recognizes that "62" is the intermediate value (e.g., median) among the brightness values for this area, and thus selects "62" as the intermediate value for this area.

The picture quality process part 2 also modulates the brightness of data which generates a dynamic range expansion through a data stretching based on the intermediate brightness value of each divided area by use of a pre-set data stretching curve. (S3) The data stretching curve can be realized as a lookup table which selects the modulated brightness data corresponding to the brightness of the input data among the pre-set modulated brightness data by having the brightness value of the input data as its address. At the same time as the data modulation, the picture quality process part 2 generates the k number of control signals CBL1 to CBLk for selectively controlling the brightness of the backlight sources BL1 to BLk according to the brightness of the intermediate value obtained for each of the divided areas. (S4)

If the modulation of data and the backlight brightness are controlled for the dynamic range expansion in each divided area, the brightness of the liquid crystal display device is partially controlled in accordance with the screen to reduce an unnecessary heating value and power consumption of the backlight, and the brightness in each divided area can be actively controlled in accordance with the video data. In addition, the brightness of the backlight source is controlled to correspond with the intermediate brightness value obtained for each divided area, thereby preventing a rapid brightness deviation between the divided areas.

Figure 6:
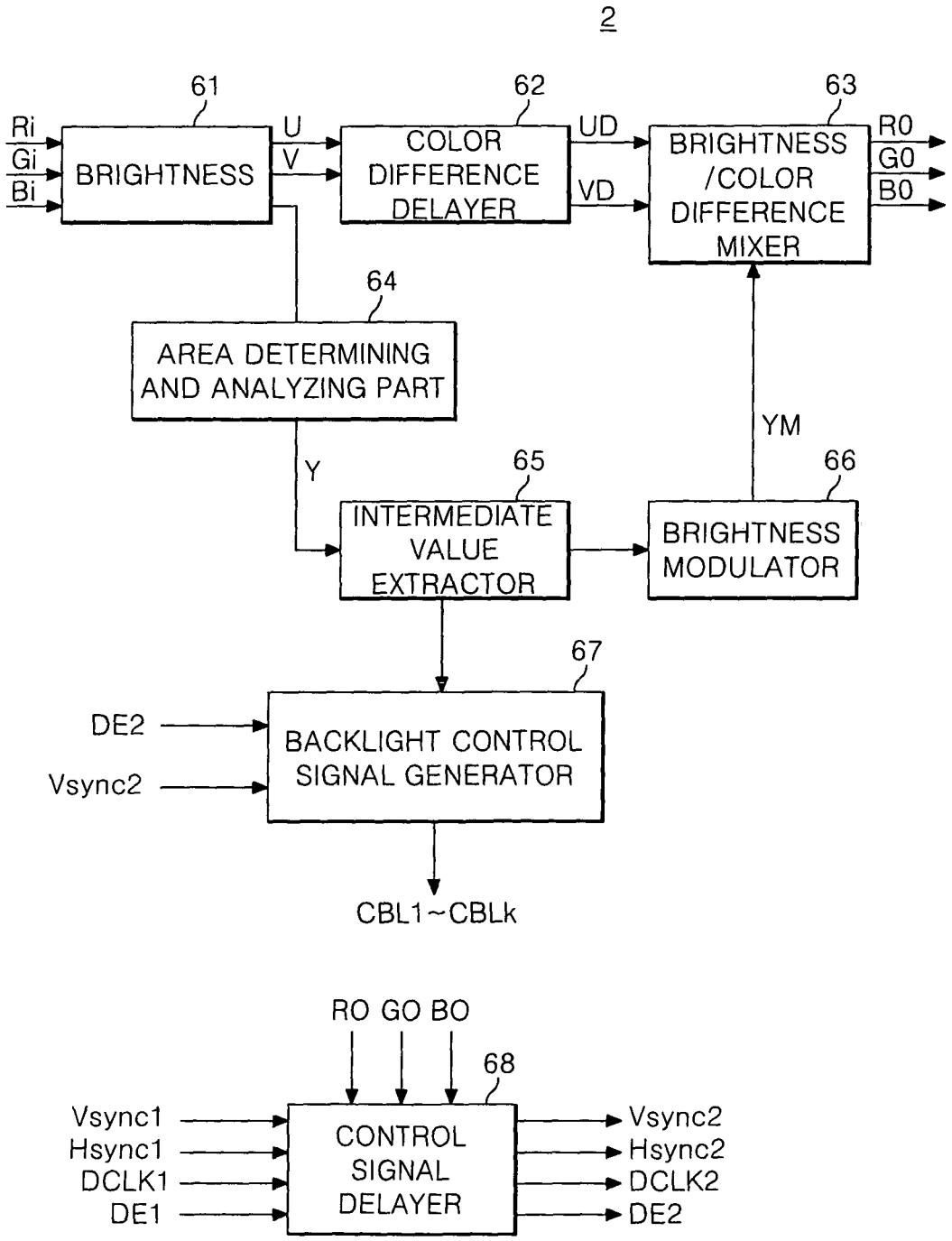
FIG. 6 is a block diagram briefly representing a circuit composition of the picture quality process part 2 shown in FIG. 2 according to an embodiment of the present invention.

FIG. 6 represents a circuit composition of the picture quality process part 2 in detail according to an embodiment of the present invention.

Referring to FIG. 6, the picture quality process part 2 includes a brightness/color difference separator 61, a color difference delayer 62, a brightness/color difference mixer 63, an area determining and analyzing part 64, an intermediate value extractor 65, a brightness modulator 66, a backlight control signal generator 67, and a control signal delayer 68, all operatively coupled.

The brightness/color difference separator 61 separates a brightness component Y and color difference components U, V from the digital video data Ri, Gi, Bi, which are received from the system 1, by FORMULAs 1 to 3 below.

$$Y=0.229\times Ri+0.587\times Gi+0.114\times Bi \quad \text{[FORMULA 1]}$$

$$U=0.493\times(Bi-Y) \quad \text{[FORMULA 2]}$$

$$V=0.887\times(Ri-Y) \quad \text{[FORMULA 3]}$$

The color difference delayer 62 delays the color difference components U, V by as much as the process time of the area determining part 64, the intermediate value extractor 65 and the brightness modulator 66 for the brightness modulation of data by areas, so as to synchronize the modulated brightness component YM with the delayed color difference components UD, VD.

The brightness/color difference mixer 63 outputs the modulated red, green and blue data Ro, Go, Bo by use of the following FORMULAs 4 to 6 having the delayed color difference components UD, VD and the modulated brightness component YM inputted from the brightness modulator 66 as variables.

$$Ro=YM+(0.000\times UD)+(1.140\times VD) \quad \text{[FORMULA 4]}$$

$$Go=YM-(0.396\times UD)-(0.581\times VD) \quad \text{[FORMULA 5]}$$

$$Bo=YM+(2.029\times UD)+(0.000\times VD) \quad \text{[FORMULA 6]}$$

The area determining and analyzing part 64 separates the brightness component Y, which is from the brightness/color difference separator 61, by the divided areas of the screen. That is, the received data is analyzed and separated to obtain the brightness component Y for each divided area DA on the screen. And, the area determining and analyzing part 64 analyzes the brightness components Y within each of the divided areas on the panel and supplies the brightness components Y to the intermediate value extractor 65 for each divided area.

As described in connection with FIG. 5, the intermediate value extractor 65 extracts, for each divided area, the intermediate value among the brightness components Y received from the area determining and analyzing part 64 as an intermediate value for that divided area. The intermediate value extractor 65 can be realized with a median filter as discussed above.

The brightness modulator 66 modulates the brightness component of each data to generate the modulated brightness data YM, with centering around the intermediate value inputted from the intermediate value extractor 65. The modulation process may involve the use of a lookup table. In this lookup table, modulated brightness data YM of pre-set input brightness Vs. output brightness are pre-registered. For instance, the lookup table may indicate what YM should be in view of certain intermediate value and input brightness data. Any known modulation technique may be used.

The backlight control signal generator 67 receives the intermediate brightness value(s) for one or more of the divided areas (DAs) from the intermediate value extractor 65, and generates one or more control signals CBL1 to CBLk for controlling the brightness of the backlight sources BL1 to BLk selectively in response to the data enable signal DE2 and the vertical synchronization signal Vsync2.

The control signal delayer 68 delays the timing signals Vsync1, Hsnc1, DCLK1, DE1 from the system 1 by as much as the time required for the data modulation process, thereby outputting the timing signals Vsync2, Hsnc2, DCLK2, DE2 synchronized with the modulated data Ro, Go, Bo.

On the other hand, the data modulating method for the dynamic range expansion of the input video data is not limited to the embodiment disclosed herein. For example, the modulation methods, which are disclosed in Korean Patent Application No. 10-2003-036289 filed on Jun. 5, 2003, No. 10-2003-040127 filed on Jun. 20, 2003, No. 10-2003-041127 filed on Jun. 24, 2003, No. 10-2003-80177 filed on Nov. 13, 2003, No. 10-2003-81171 filed on Nov. 17, 2003, No. 10-2003-81172 filed on Nov. 17, 2003, No. 10-2003-81173 filed on Nov. 17, 2003 and No. 10-2003-81175 filed on Nov. 17, 2003, can be applied in the present invention. All these Korean applications are owned by the Assignee of the present application, and the entire contents of these applications are herein incorporated by reference.

As described above, the liquid crystal display device and a controlling method thereof according to the present invention actively control the brightness of the liquid crystal display device in accordance with the video data, thereby increasing the display quality and reducing the heating value of the backlight unit and the power consumption. The liquid crystal display device and a controlling method thereof according to the present invention divide the screen into a plurality of areas and can control the backlight brightness in each of the divided areas in accordance with the video data. In addition, the invention controls the brightness of the backlight sources selectively with the intermediate value in each of the divided areas, and thus it is possible to reduce the deviation of the backlight and image which can be generated if the deviation of the average value by areas is large.

Although the present invention has been explained by the embodiments shown in the drawings described above, it should be understood to the ordinary skilled person in the art that the invention is not limited to the disclosed embodiments, but rather that various changes or modifications thereof are possible without departing from the spirit of the invention. Accordingly, the scope of the invention shall be determined only by the appended claims and their equivalents.

What is claimed is:

1. A liquid crystal display device, comprising:

a liquid crystal display panel screen divided into a plurality of areas, each of which contains a plurality of pixels;

a plurality of lamp tube backlight sources to selectively irradiate light respectively to the divided areas of the screen; and a controller to obtain at least one intermediate value of the brightness of the plurality of pixels of at least one of the divided areas and to control a brightness of at least one of the backlight sources which selectively illuminates the at least one divided area according to the at least one intermediate brightness value to prevent a rapid brightness deviation between said at least one of the divided areas and another divided area, wherein the controller includes:

a brightness/color difference separator to separate brightness and color difference components of the data;

an area determiner to divide the brightness component obtained from the brightness/color difference separator to correspond with the divided areas, an intermediate value extractor to extract an intermediate value of the brightness component for each of the divided areas;

a brightness modulator to modulate the brightness component of the data by using the extracted intermediate values;

a color difference delayer to delay the color difference components of the data by as much as a process time of the area determiner, the intermediate value extractor and the brightness modulator during a process time for modulating the brightness by areas of the brightness modulator wherein the modulated brightness component is synchronized with the delayed color difference components;

a brightness/color difference mixer to mix the modulated brightness component and the delayed color difference component; and a control signal delayer to delay timing signals supplied from a system during a time required for the data modulation process by the controller, and wherein each of the divided areas is 3*3 pixels, and the intermediate value is the fifth brightness value among the brightness values of the 3*3 pixels in order.

2. The liquid crystal display device according to claim 1, wherein the controller controls the brightness of each of the backlight sources independently from each other.

3. The liquid crystal display device according to claim 1, wherein the controller generates at least one drive control signal corresponding to the at least one intermediate brightness value.

4. The liquid crystal display device according to claim 3, further comprising:

a plurality of light source drivers to selectively drive the backlight sources in response to the at least one drive control signal.

5. The liquid crystal display device according to claim 1, wherein the controller modulates the data based on the at least one intermediate brightness value.

6. The liquid crystal display device according to claim 1, wherein the intermediate value extractor includes a median filter.

7. A method of controlling a liquid crystal display device, the liquid crystal display device including a liquid crystal display panel screen divided into a plurality of areas, each of which contains a plurality of pixels, and a plurality of lamp tube backlight sources, the method comprising:

obtaining at least one intermediate brightness value associated with input data for the plurality of pixels in at least one of the divided areas; and controlling a brightness of at least one of the lamp tube backlight sources corresponding to the at least one divided area according to the at least one intermediate brightness value to prevent a rapid difference in brightness between plural divided areas and to affect power consumption of, and heat generated by, the backlight sources, wherein the controlling step includes:

separating brightness and color difference components of the data;

dividing the brightness component to correspond with the divided areas;

extracting an intermediate value of the brightness component for each of the divided areas;

modulating the brightness component of the data by using the extracted intermediate values;

delaying the color difference components of the data by as much as a process time of the steps of dividing the brightness component, extracting an intermediate value of the brightness component and modulating the brightness component of the data during a process time for modulating the brightness areas of a brightness modulator, wherein the modulated brightness component synchronized with the delayed color components;

mixing the modulated brightness component and the delayed color difference component by using a brightness/color difference mixer; and delaying timing signals supplied from a system by using a control signal during a time required for the controlling step, and wherein each of the divided areas is 3*3 pixels and the intermediate value is the fifth brightness value among the brightness values of the 3*3 pixels in order.

8. The method according to claim 7, wherein in the controlling step, the brightness of each of the backlight sources is controlled independently from each other.

9. The method according to claim 7, further comprising:

modulating the data based on the at least one intermediate brightness value.

10. The method according to claim 7, wherein the extracted intermediate values are median values.

* * * * *